US011309113B2

(12) United States Patent
Ito

(10) Patent No.: US 11,309,113 B2
(45) Date of Patent: Apr. 19, 2022

(54) MULTILAYER SUBSTRATE, ACTUATOR, AND METHOD OF MANUFACTURING MULTILAYER SUBSTRATE

(71) Applicant: Murata Manufacturing Co., Ltd., Nagaokakyo (JP)

(72) Inventor: Shingo Ito, Nagaokakyo (JP)

(73) Assignee: MURATA MANUFACTURING CO., LTD, Kyoto (JP)

( * ) Notice: Subject to any disclaimer, the term of this patent is extended or adjusted under 35 U.S.C. 154(b) by 304 days.

(21) Appl. No.: 16/511,012

(22) Filed: Jul. 15, 2019

(65) Prior Publication Data

US 2019/0341180 A1 Nov. 7, 2019

Related U.S. Application Data

(63) Continuation of application No. PCT/JP2018/011308, filed on Mar. 22, 2018.

(30) Foreign Application Priority Data

Mar. 24, 2017 (JP) ..... JP2017-059289

(51) Int. Cl.
*H01F 7/08* (2006.01)
*H01F 7/126* (2006.01)
(Continued)

(52) U.S. Cl.
CPC ..... *H01F 7/081* (2013.01); *H01F 7/126* (2013.01); *H01F 7/16* (2013.01); *H01F 27/2804* (2013.01); *H01F 2027/2809* (2013.01)

(58) Field of Classification Search
CPC ..... H01F 7/081; H01F 2007/068; H01F 2027/2809; H01F 27/2804; H01F 7/126; H01F 7/16; H01F 7/1646
See application file for complete search history.

(56) References Cited

U.S. PATENT DOCUMENTS 6,310,056 B1 * 10/2001 Kano ..... A61P 31/04 514/210.14
9,978,502 B2 * 5/2018 Gouchi ..... H01F 41/041
(Continued)

FOREIGN PATENT DOCUMENTS

JP 05-36532 A 2/1993
JP 2012-164770 A 8/2012
(Continued)

OTHER PUBLICATIONS

Official Communication issued in Japanese Patent Application No. 2019-506957, dated Oct. 1, 2019.
(Continued)

*Primary Examiner* — Bernard Rojas
(74) *Attorney, Agent, or Firm* — Keating & Bennett, LLP

(57) ABSTRACT

A multilayer substrate includes a stacked body including a principal surface and insulating base material layers made of a thermoplastic resin that are stacked, and a coil including coil conductors. The coil includes a winding axis in a stacking direction. The coil conductors includes a first coil conductor closest to the principal surface, and a second coil conductor adjacent to or in a vicinity of the first coil conductor. The second coil conductor includes a wide portion of which a line width is larger than a line width of the first coil conductor. The wide portion includes an overlapping portion that overlaps with the first coil conductor, and a non-overlapping portion that does not overlap with the first coil conductor, when viewed from the stacking direction. The non-overlapping portion is curved to be closer to the principal surface than to the overlapping portion.

17 Claims, 9 Drawing Sheets

(51) Int. Cl.
*H01F 27/28* (2006.01)
*H01F 7/16* (2006.01)

(56) References Cited

U.S. PATENT DOCUMENTS

| | | | | |
|---|---|---|---|---|
| 10,796,837 | B2 * | 10/2020 | Ito | H05K 1/181 |
| 10,867,765 | B2 * | 12/2020 | Yosui | H01H 50/443 |
| 2016/0012950 | A1 | 1/2016 | Nishino et al. | |
| 2016/0049237 | A1 | 2/2016 | Yosui | |
| 2016/0165720 | A1 | 6/2016 | Nishino et al. | |
| 2017/0365389 | A1 | 12/2017 | Yosui et al. | |

FOREIGN PATENT DOCUMENTS

| | | | |
|---|---|---|---|
| JP | 2015-201606 | A | 11/2015 |
| WO | 2015/005161 | A1 | 1/2015 |
| WO | 2015/079773 | A1 | 6/2015 |
| WO | 2015/129600 | A1 | 9/2015 |
| WO | 2016/199516 | A1 | 12/2016 |

OTHER PUBLICATIONS

Official Communication issued in International Patent Application No. PCT/JP2018/011308, dated Jun. 5, 2018.

* cited by examiner

MULTILAYER SUBSTRATE, ACTUATOR, AND METHOD OF MANUFACTURING MULTILAYER SUBSTRATE

CROSS REFERENCE TO RELATED APPLICATIONS

This application claims the benefit of priority to Japanese Patent Application No. 2017-59289 filed on Mar. 24, 2017 and is a Continuation Application of PCT Application No. PCT/JP2018/011308 filed on Mar. 22, 2018. The entire contents of each application are hereby incorporated herein by reference.

BACKGROUND OF THE INVENTION

1. Field of the Invention

The present invention relates to a multilayer substrate, and more particularly, to a multilayer substrate including a plurality of coil conductors in contact with a plurality of insulating base material layers, an actuator including such a multilayer substrate, and a method of manufacturing such a multilayer substrate.

2. Description of the Related Art

Conventionally, a multilayer substrate in which a stacked body provided by stacking a plurality of insulating base material layers that includes a coil has been known. For example, Japanese Unexamined Patent Application Publication No. H5-036532 discloses a multilayer substrate in which a coil includes a plurality of coil conductors provided on a plurality of insulating base material layers. In the multilayer substrate, in order to significantly reduce variations in stray capacitance between the coil conductors due to a shift of a printing position of a pattern or a shift of a stacking position, among the plurality of coil conductors adjacent to each other in the stacking direction of the plurality of insulating base material layers, a line width of one of the coil conductors is smaller than a line width of the other coil conductor.

A plurality of insulating base material layers including a thermoplastic resin may be stacked to form a stacked body. However, in such a case, the insulating base material layers may flow when heated and pressed while the stacked body is formed, which may cause a positional shift of a coil conductor. In particular, a coil conductor with a small line width tends to cause a positional shift, compared with a coil conductor with a large line width.

In addition, a vicinity of a surface layer of the stacked body is easily affected by heat by a pressing machine during heating and pressing, and a coil conductor disposed in the vicinity of the surface layer of the stacked body tends to cause a positional shift. Therefore, in a case in which a coil conductor with a small line width is disposed in the vicinity of the surface layer of the stacked body, a positional shift of the coil conductor with a small line width tends to be large, and predetermined coil characteristics may not be obtained.

SUMMARY OF THE INVENTION

Preferred embodiments of the present invention provide multilayer substrates in which, in a configuration provided with a coil including a plurality of coil conductors provided in contact with a plurality of insulating base material layers, a positional shift of the coil conductors when a stacked body is formed is significantly reduced or prevented, and thus a change in characteristics of the coil is significantly reduced or prevented, and also provide actuators including such multilayer substrates, and methods of manufacturing such multilayer substrates.

A multilayer substrate according to a preferred embodiment includes a stacked body including a principal surface and provided by stacking a plurality of insulating base material layers including a thermoplastic resin, and a coil including a plurality of coil conductors provided on the plurality of insulating base material layers, and a winding axis in a stacking direction in which the plurality of insulating base material layers are stacked, and the plurality of coil conductors include a first coil conductor that is the closest to the principal surface, and a second coil conductor adjacent to or in a vicinity of the first coil conductor and including a wide portion of which a line width is larger than a line width of the first coil conductor; the wide portion includes an overlapping portion that overlaps with the first coil conductor when viewed from the stacking direction, and a non-overlapping portion that does not overlap with the first coil conductor when viewed from the stacking direction; and the non-overlapping portion is curved to be closer to the principal surface than to the overlapping portion.

The vicinity of a surface layer of the stacked body is easily affected by heat by a pressing machine during heating and pressing, and a coil conductor in the vicinity of the surface layer of the stacked body tends to cause a positional shift during heating and pressing. On the other hand, with the above-described configuration, a flow (a flow in a plane direction, in particular) of an insulating base material layer in the vicinity of the principal surface (a first principal surface) during heating and pressing when a stacked body is formed is significantly reduced or prevented by a curved non-overlapping portion (the second coil conductor). Therefore, with this configuration, a positional shift (a positional shift in the plane direction, in particular) of the first coil conductor during heating and pressing, the first coil conductor being the closest to the vicinity of the first principal surface of the stacked body is significantly reduced or prevented, so that a change in characteristics of a coil due to a positional shift, deformation, or the like of the first coil conductor is able to be significantly reduced or prevented.

A coil conductor with a small line width, compared with a coil conductor with a large line width, tends to cause a positional shift due to a flow of the insulating base material layer including a thermoplastic resin during heating and pressing when a stacked body is formed. Therefore, in a case in which the line width of the first coil conductor that is the closest to the first principal surface of the stacked body is smaller than the line width of other coil conductors, the configuration is particularly effective.

Further, with this configuration, since the non-overlapping portion of the second coil conductor (the wide portion) is curved, as compared with a case in which the non-overlapping portion is not curved, a positional shift of the second coil conductor during heating and pressing is unlikely to occur.

The non-overlapping portion may preferably include a portion that is curved to a same or substantially a same position as a position of the first coil conductor in the stacking direction. With this configuration, a flow of an insulating base material layer in the vicinity of the first principal surface during heating and pressing is further significantly reduced or prevented, so that a positional shift of the first coil conductor during heating and pressing is further significantly reduced or prevented.

The non-overlapping portion, when viewed from the stacking direction, may preferably be located on an outer peripheral side in a radial direction of the second coil conductor, at the wide portion. With this configuration, the non-overlapping portion does not prevent a magnetic field generation (e.g., magnetic flux that passes through a coil opening of the coil) of the coil.

The non-overlapping portion, when viewed from the stacking direction, may preferably be located on an inner peripheral side in a radial direction of the second coil conductor, at the wide portion. With this configuration, for example, in a case in which a member (an interlayer connection conductor or another conductor) with a flowability lower than the flowability of a thermoplastic resin at a temperature during heating and pressing is provided outside of a coil, since the first coil conductor is located between the member and the non-overlapping portion, a positional shift of the first coil conductor during heating and pressing is further significantly reduced or prevented.

The first coil conductor, when viewed from the stacking direction, may preferably include an area of which more than half overlaps with the wide portion. In a case in which a large portion of the first coil conductor does not overlap with the wide portion when viewed from the stacking direction, a positional shift, deformation, or the like of the first coil conductor easily occurs. Therefore, with this configuration, a positional shift, deformation, or the like of the first coil conductor is able to be significantly reduced or prevented.

An actuator according to a preferred embodiment includes the multilayer substrate and a magnet, and the magnet is closest to the first coil conductor among the plurality of coil conductors.

With this configuration, an actuator provided with the multilayer substrate in which a change in characteristics of the coil due to a positional shift, deformation, or the like of the first coil conductor during heating and pressing is significantly reduced or prevented is able to be provided.

A method of manufacturing a multilayer substrate includes, in sequence, a coil conductor forming step of forming a plurality of coil conductors on a plurality of insulating base material layers including a thermoplastic resin, the plurality of coil conductors including a first coil conductor and a second coil conductor including a wide portion of which a line width is larger than a line width of the first coil conductor; a stacking step of stacking the plurality of insulating base material layers such that the second coil conductor is adjacent to or in a vicinity of the first coil conductor; and a stacked body forming step of forming a stacked body including a principal surface by heating and pressing the plurality of insulating base material layers that have been stacked. The first coil conductor among the plurality of coil conductors is closest to the principal surface and a non-overlapping portion of the wide portion is curved to be closer to the principal surface than to an overlapping portion of the wide portion, the non-overlapping portion does not overlap with the first coil conductor when viewed from a stacking direction of the plurality of insulating base material layers, and the overlapping portion overlaps with the first coil conductor when viewed from the stacking direction.

With the above-described manufacturing method, a multilayer substrate in which a positional shift of the coil conductors when a stacked body is formed is significantly reduced or prevented, and thus a change in characteristics of the coil is significantly reduced or prevented.

According to various preferred embodiments of the present invention, in a configuration provided with a coil including a plurality of coil conductors provided in contact with a plurality of insulating base material layers, a multilayer substrate in which a positional shift of the coil conductors when a stacked body is formed is significantly reduced or prevented and thus a change in characteristics of the coil is significantly reduced or prevented, and an actuator including such a multilayer substrate are able to be provided.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1A:
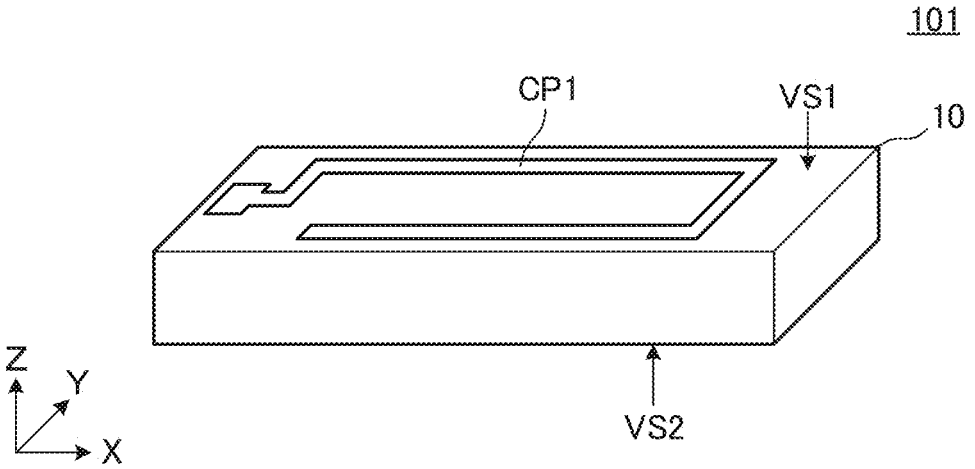
FIG. 1A is an external perspective view of a multilayer substrate 101 according to a first preferred embodiment of the present invention.

Hereinafter, a plurality of preferred embodiments of the present invention will be described with reference to the attached drawings and several specific examples. In the drawings, components and elements assigned with the same reference numerals or symbols will represent the same or similar components and elements. While preferred embodiments of the present invention are divided and described for the sake of convenience in consideration of ease of description or understanding of main points, elements described in different preferred embodiments are able to be partially replaced and combined with each other. In second and subsequent preferred embodiments, a description of matters common to the first preferred embodiment will be omitted and only different points are described. In particular, the same or substantially the same advantageous functions and effects by the same configuration will not be described one by one for each preferred embodiment.

First Preferred Embodiment

Figure 1B:
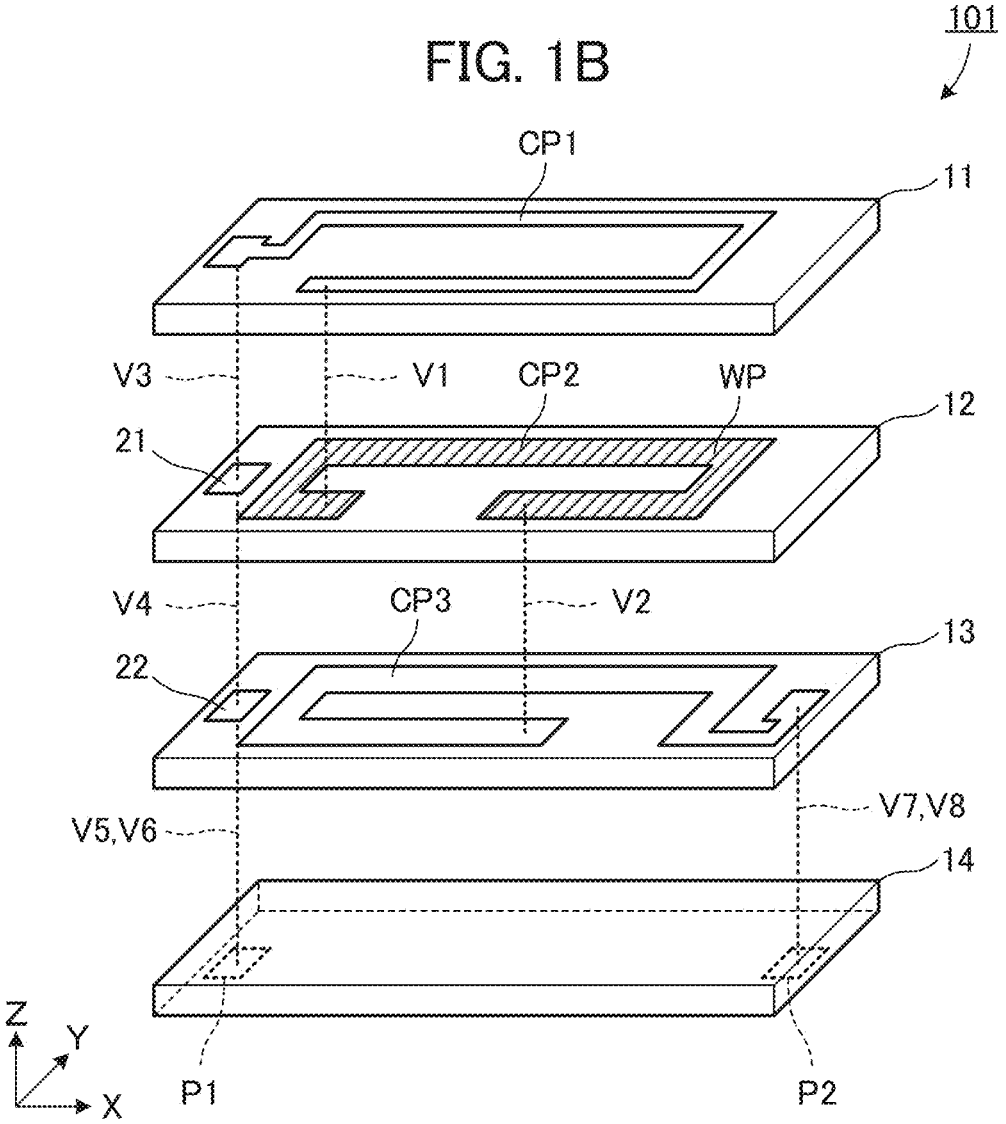
FIG. 1B is an exploded perspective view of the multilayer substrate 101.
Figure 2:
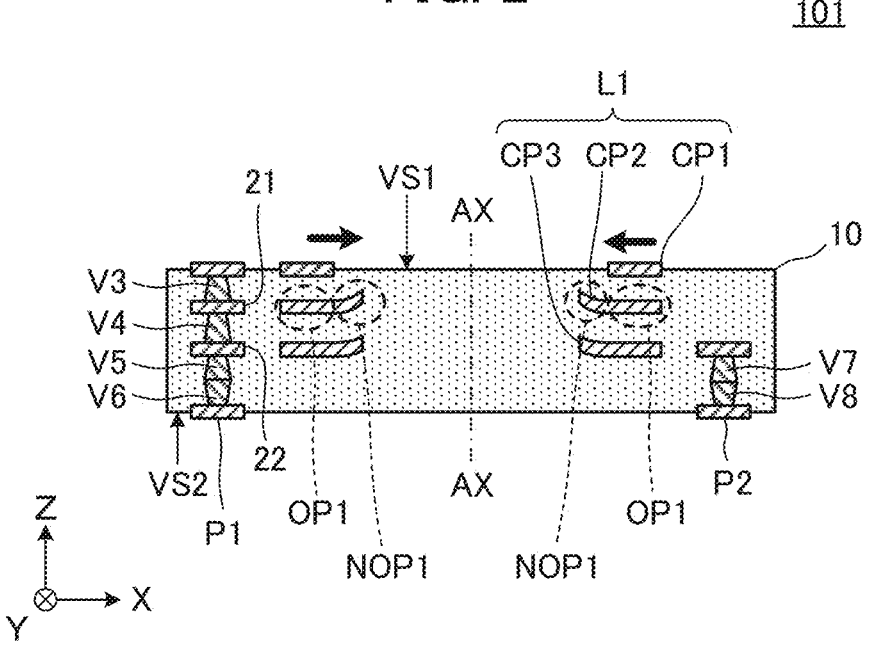
FIG. 2 is a cross-sectional view of the multilayer substrate 101.

FIG. 1A is an external perspective view of a multilayer substrate 101 according to a first preferred embodiment of the present invention, and FIG. 1B is an exploded perspective view of the multilayer substrate 101. FIG. 2 is a cross-sectional view of the multilayer substrate 101. In FIG. 1B, in order to make the structure more understandable, a wide portion WP is indicated by hatching. In addition, in FIG. 2, the thickness of each portion is indicated in an exaggerated manner. The same or similar hatching and exaggerated features may be applied to a cross-sectional view in each of the following preferred embodiments.

The multilayer substrate 101 includes a stacked body 10, a coil L1 (described below) provided in contact with the stacked body 10, and external electrodes P1 and P2.

The stacked body 10 is a flat plate having a rectangular or substantially rectangular shape of which the longitudinal direction coincides with the X-axis direction and includes a first principal surface VS1 and a second principal surface VS2 that face each other. The stacked body 10, as shown FIG. 1B, is formed by stacking a plurality of insulating base material layers 14, 13, 12, and 11 that are preferably made of a thermoplastic resin in this order. Each of the plurality of insulating base material layers 11, 12, 13, and 14 is flexible and is a flat plate having a rectangular or substantially rectangular shape of which the longitudinal direction coincides with the X-axis direction. The plurality of insulating base material layers 11, 12, 13, and 14 are sheets are preferably made of a liquid crystal polymer (LCP) or a polyether ether ketone (PEEK), for example, as a main material.

A coil conductor CP1 is provided on a surface of the insulating base material layer 11. The coil conductor CP1 is a rectangular or substantially rectangular loop-shaped conductor of about 1 turn wound along the outer periphery of the insulating base material layer 11. The coil conductor CP1 is a conductor pattern preferably made of, for example, a Cu foil or a similar foil.

The insulating base material layer 11 includes interlayer connection conductors V1 and V3.

A coil conductor CP2 and a conductor 21 are provided on a surface of the insulating base material layer 12. The coil conductor CP2 is a rectangular or substantially rectangular loop-shaped conductor of about 1 turn wound along the outer periphery of the insulating base material layer 12. The conductor 21 is a rectangular or substantially rectangular conductor disposed in a vicinity of the center of a first side (the left side of the insulating base material layer 12 in FIG. 1B) of the insulating base material layer 12. The coil conductor CP2 and the conductor 21 are conductor patterns preferably made of, for example, a Cu foil or a similar foil.

The insulating base material layer 12 includes interlayer connection conductors V2 and V4.

A coil conductor CP3 and a conductor 22 are provided on a surface of the insulating base material layer 13. The coil conductor CP3 is a rectangular or substantially rectangular loop-shaped conductor of about 1 turn wound along the outer periphery of the insulating base material layer 13. The conductor 22 is a rectangular or substantially rectangular conductor disposed in a vicinity of the center of a first side (the left side of the insulating base material layer 13 in FIG. 1B) of the insulating base material layer 13. The coil conductor CP3 and the conductor 22 are conductor patterns preferably made of, for example, a Cu foil or a similar foil.

In addition, the insulating base material layer 13 includes interlayer connection conductors V5 and V7.

External electrodes P1 and P2 are provided on a back surface of the insulating base material layer 14. The external electrode P1 is a rectangular or substantially rectangular conductor disposed in a vicinity of the center of a first side (the left side of the insulating base material layer 14 in FIG. 1B) of the insulating base material layer 14. The external electrode P2 is a rectangular or substantially rectangular conductor disposed in the vicinity of the center of a second side (the right side of the insulating base material layer 14 in FIG. 1B) of the insulating base material layer 14. The external electrodes P1 and P2 are conductor patterns preferably made of, for example, a Cu foil or a similar foil.

In addition, the insulating base material layer 14 includes interlayer connection conductors V6 and V8.

As shown in FIG. 1B, a first end of the coil conductor CP1 is electrically connected to a first end of the coil conductor CP2 through the interlayer connection conductor V1. A second end of the coil conductor CP2 is electrically connected to a first end of the coil conductor CP3 through the interlayer connection conductor V2. Accordingly, the coil conductors CP1, CP2, and CP3 respectively provided on the insulating base material layers 11, 12, and 13 and the interlayer connection conductors V1 and V2 define a coil L1 including about 3 turns. The coil L1 is provided in contact with the stacked body 10, and includes a winding axis AX in the stacking direction (the Z-axis direction) of the plurality of insulating base material layers 11, 12, 13, and 14.

It is to be noted that, while the first preferred embodiment shows an example in which the winding axis AX of the coil L1 coincides with the stacking direction (the Z-axis direction) of the plurality of insulating base material layers 11, 12, 13, and 14, the winding axis AX of the coil L1 is not required to strictly coincide with the Z-axis direction. In various preferred embodiments of the present invention, a description of "including the winding axis in the stacking direction of the plurality of insulating base material layers" also includes a case in which the winding axis AX of the coil L1 extending in a range from about minus 30 degrees to about plus 30 degrees with respect to the Z-axis direction, for example.

In addition, a first end (a second end of the coil conductor CP1) of the coil L1 is electrically connected to the external electrode P1, and a second end (a second end of the coil conductor CP3) of the coil L1 is electrically connected to the external electrode P2. Specifically, as shown in FIG. 1B, the first end (the second end of coil conductor CP1) of the coil L1 is electrically connected to the external electrode P1 through the conductors 21 and 22 and the interlayer connection conductors V3, V4, V5, and V6. The second end (the second end of the coil conductor CP3) of the coil L1 is electrically connected to the external electrode P2 through the interlayer connection conductors V7 and V8.

As shown in FIG. 2, among the plurality of coil conductors CP1, CP2, and CP3, the coil conductor CP1 is closest to the first principal surface VS1 of the stacked body 10, and the coil conductor CP2 is disposed adjacent to or in a vicinity of the coil conductor CP1.

In the first preferred embodiment, the coil conductor CP1 corresponds to an example of the "first coil conductor", and the coil conductor CP2 corresponds to an example of the "second coil conductor".

In addition, as shown in FIG. 1B, the second coil conductor (the coil conductor CP2) includes a wide portion WP of which the line width is larger than the line width of the first coil conductor (the coil conductor CP1). In the first preferred embodiment, the entire or substantially the entire coil conductor CP2 is the wide portion WP. As shown in FIG. 2, the wide portion WP of the second coil conductor (the coil conductor CP2) includes an overlapping portion OP1 that overlaps with the first coil conductor (the coil conductor CP1) when viewed from the Z-axis direction and a non-overlapping portion NOP1 that does not overlap with the first coil conductor (the coil conductor CP1) when viewed from the Z-axis direction. As shown in FIG. 2, the non-overlapping portion NOP1 is curved (bent) to be closer to the first principal surface VS1 than to the overlapping portion OP1.

In the first preferred embodiment, more than half of the area of the first coil conductor (the coil conductor CP1) overlaps with the wide portion WP of the second coil conductor (the coil conductor CP2). In addition, in the first preferred embodiment, the non-overlapping portion NOP1 is located on the inner peripheral side (the side of the coil conductor CP2 closer to the winding axis AX) in the radial direction of the second coil conductor (the coil conductor CP2).

Figure 3:
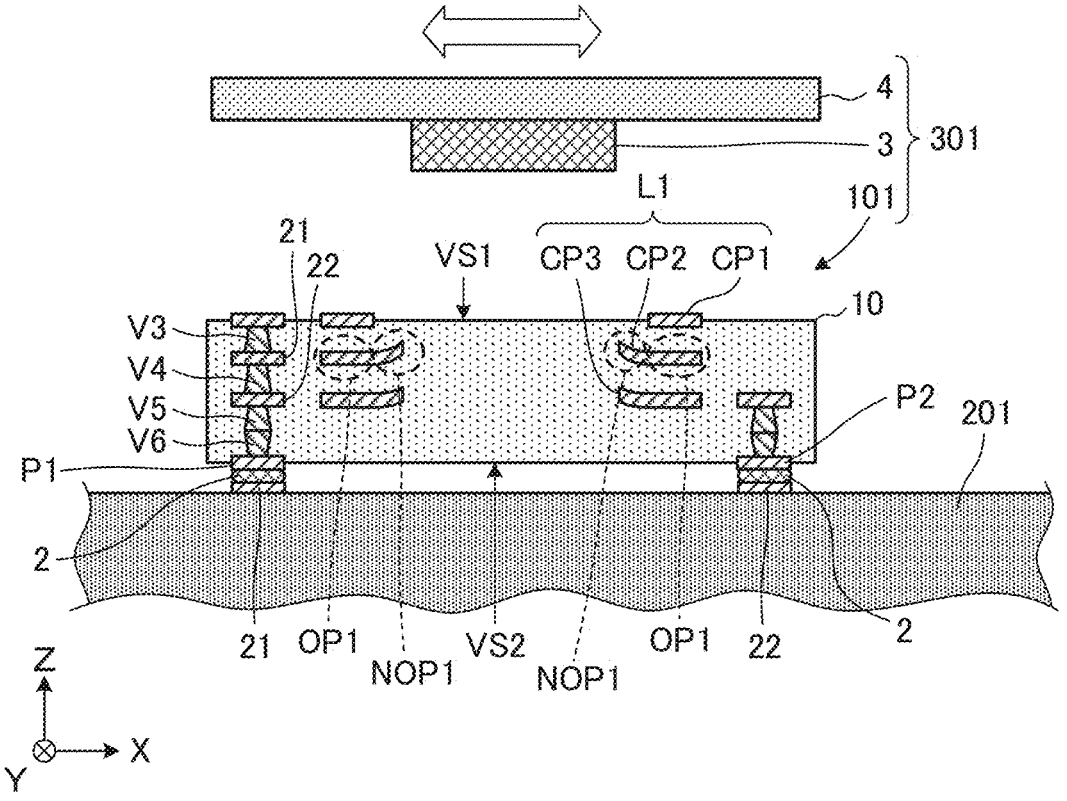
FIG. 3 is a cross-sectional view showing a main portion of an electronic device 401 including the multilayer substrate 101.

The multilayer substrate 101 is implemented as follows, for example. FIG. 3 is a cross-sectional view showing a main portion of an electronic device 401 including the multilayer substrate 101.

The electronic device 401 includes an actuator 301 and a circuit board 201. The actuator 301 includes the multilayer substrate 101, a magnet 3, and a movable object 4 and is incorporated into the electronic device 401. In the actuator 301, the movable object 4 is not indispensable.

The multilayer substrate 101 is mounted on the circuit board 201. Specifically, the external electrodes P1 and P2 of the multilayer substrate 101 are, respectively, electrically connected to the conductors 21 and 22 that are provided on the surface of the circuit board 201 through a conductive bonding material 2. The conductive bonding material 2 may preferably be, for example, solder.

The magnet 3 shown in FIG. 3 is attached to the movable object 4. The magnet 3, as shown in FIG. 3, is closest to the first coil conductor (the coil conductor CP1) among the plurality of coil conductors CP1, CP2, and CP3. In other words, the magnet 3 is not disposed on the side of the second principal surface VS2 of the stacked body 10 but on the side of the first principal surface VS1.

When a predetermined current flows into the coil L1, by a magnetic field emitted from the coil L1, the magnet 3 and the movable object 4 are displaced in a direction (the Y-axis direction) perpendicular or substantially perpendicular to the stacking direction (the Z-axis direction) (see a white arrow shown in FIG. 3).

According to the multilayer substrate 101 and the actuator 301 of the first preferred embodiment, the following advantageous effects may be obtained.

(a) Generally, the vicinity of a surface layer of the stacked body is easily affected by heat by a pressing machine during heating and pressing, and a coil conductor disposed in the vicinity of the surface layer of the stacked body tends to cause a positional shift during heating and pressing. On the other hand, in the first preferred embodiment, the second coil conductor (the coil conductor CP2) including the wide portion WP of which the line width is larger than the line width of the first coil conductor (the coil conductor CP1) is disposed adjacent to or in a vicinity of the first coil conductor, and the non-overlapping portion NOP1 of the second coil conductor is curved to be closer to the first principal surface VS1 than to the overlapping portion OP1. With this configuration, a flow (a flow in a plane direction, in particular) of an insulating base material layer in the vicinity of the first principal surface VS1 during heating and pressing when a stacked body 10 is formed is significantly reduced or prevented by a curved non-overlapping portion NOP1 (the second coil conductor). Therefore, with this configuration, a positional shift (a positional shift of the first coil conductor in a direction indicated by an arrow in FIG. 2) of the first coil conductor during heating and pressing, the first coil conductor being the closest to the vicinity of a surface (the first principal surface VS1) of the stacked body 10 is significantly reduced or prevented, so that a change in characteristics of a coil due to a positional shift, deformation, or the like of the first coil conductor is able to be significantly reduced or prevented.

In addition, generally, a coil conductor with a small line width, compared with a coil conductor with a large line width, tends to cause a positional shift due to a flow of the insulating base material layer made of a thermoplastic resin during heating and pressing when a stacked body is formed. Therefore, as with the multilayer substrate 101 according to the present preferred embodiment, in the case in which the line width of the coil conductor CP1 that is the closest to the surface (the first principal surface VS1) of the stacked body 10 is smaller than the line width of the other coil conductors CP2 and CP3, the configuration is particularly effective.

It is to be noted that, in the first preferred embodiment, the non-overlapping portion NOP1 is curved to be closer to the first principal surface VS1, and a positional shift of the first coil conductor in opposite directions (see the arrows in FIG. 2) during heating and pressing may be significantly reduced or prevented. With this configuration, as compared with a case in which the non-overlapping portion NOP1 is curved to significantly reduce or prevent a positional shift of the first coil conductor in one direction, a positional shift of the first coil conductor during heating and pressing is able to be further significantly reduced or prevented.

(b) In addition, in the multilayer substrate 101, the second coil conductor (the coil conductor CP2) includes the wide portion WP of which the line width is larger than the line width of the first coil conductor (the coil conductor CP1). Therefore, compared with the first coil conductor, a positional shift of the second coil conductor during heating and pressing is unlikely to occur. Further, in the multilayer substrate 101, since the non-overlapping portion NOP1 of the wide portion WP is curved, as compared with a case in which the non-overlapping portion NOP1 is not curved, a positional shift of the second coil conductor during heating and pressing is unlikely to occur.

(c) In addition, in the first preferred embodiment, among the plurality of coil conductors CP1, CP2, and CP3, the line width of the first coil conductor (the coil conductor CP1) closest to the first principal surface VS1 is smaller than the line width of the other coil conductors CP2 and CP3. In general, as compared with a case in which the line width of the coil conductor (a pattern) that defines a coil is large, magnetic flux generated around a coil conductor is increased in a case in which the line width of a coil conductor is small. Therefore, with this configuration, electromagnetic force by interaction between the first coil conductor that is the closest to the first principal surface and the magnet is able to be increased.

(d) In addition, in the first preferred embodiment, the line width of the first coil conductor (the coil conductor CP1) is smaller than the other coil conductors CP2 and CP3. In other words, by reducing only the line width of the first coil conductor, as compared with a case in which the line widths of all of the plurality of coil conductors are the same or substantially the same under the same or substantially the same condition of conductor loss of the coil, electromagnetic force by interaction between the magnet and the coil is able to be increased. In addition, with this configuration, as compared with a case in which the line widths of all of the plurality of coil conductors CP1, CP2, and CP3 are include the same or substantially the same under the same or substantially the same condition of electromagnetic force, significant increase in conductor loss of the coil is significantly reduced or prevented.

(e) In addition, in the first preferred embodiment, the non-overlapping portion NOP1 is located on the inner peripheral side (the side of the coil conductor CP2 closer to the winding axis AX) in the radial direction of the second coil conductor (the coil conductor CP2), and the interlayer connection conductors V3, V4, V5 and V6 or the like are disposed outside the coil L1. In this configuration, the first coil conductor (the coil conductor CP1) is located between a member (an interlayer connection conductor or another conductor) with a flowability lower than the flowability of the insulating base material layer (a thermoplastic resin) at a temperature during heating and pressing and the non-overlapping portion NOP1. Therefore, a positional shift of the first coil conductor during heating and pressing is able to be further significantly reduced or prevented.

It is to be noted that the member with low flowability may be present during heating and pressing. In other words, as long as the member with low flowability is present in a state of a collective substrate to be described below, similar advantageous effects are provided. Therefore, in a state after the collective substrate is separated into individual pieces, the member with low flowability may not be present in each piece.

(f) In the first preferred embodiment, more than half of the area of the first coil conductor (the coil conductor CP1), when viewed in the Z-axis direction, overlaps with the wide portion WP of the second coil conductor (the coil conductor CP2). In a case in which a large portion of the first coil conductor does not overlap with the wide portion WP when viewed from the stacking direction, a positional shift, deformation, or the like of the first coil conductor easily occurs. Therefore, with this configuration, a positional shift, deformation, or the like of the first coil conductor is able to be significantly reduced or prevented.

Figure 4:
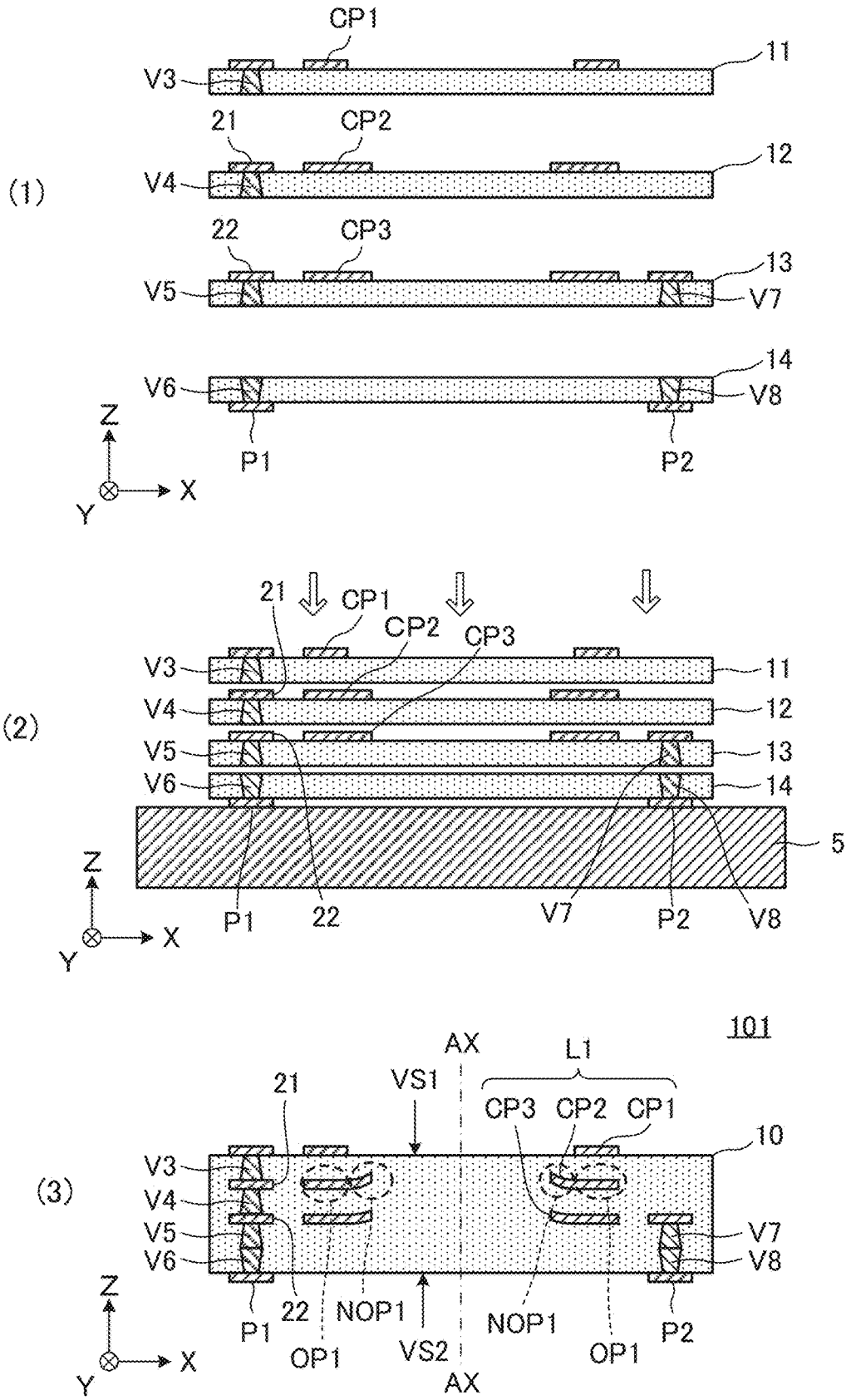
FIG. 4 is a cross-sectional view sequentially showing a process of manufacturing the multilayer substrate 101.

The multilayer substrate 101 according to the first preferred embodiment may be manufactured by, for example, the following process. FIG. 4 is a cross-sectional view sequentially showing a process of manufacturing the multilayer substrate 101. It is to be noted that, in FIG. 4, for the sake of convenience of explanation, although explanation is provided in a manufacturing process with one chip (an individual piece), the actual process of manufacturing a multilayer substrate is performed in the state of a collective substrate.

First, as shown in (1) in FIG. 4, a plurality of insulating base material layers 11, 12, 13, and 14 that are made of a thermoplastic resin are prepared. The insulating base material layers 11, 12, 13, and 14 are preferably sheets made of a material, such as a liquid crystal polymer (LCP), for example.

Subsequently, coil conductors CP1, CP2, and CP3, conductors 21 and 22, and external electrodes P1 and P2 are respectively formed on the plurality of insulating base material layers 11, 12, 13, and 14 that are made of a thermoplastic resin. Specifically, a metal foil (a Cu foil, for example) is laminated on the front surface of the insulating base material layers 11, 12, and 13 in the state of a collective substrate, and, by patterning the metal foil by photolithography, for example, coil conductors CP1, CP2, and CP3, and conductors 21 and 22 are provided on the front surface of the insulating base material layers 11, 12, and 13. In addition, a metal foil (a Cu foil, for example) is laminated on the back surface of the insulating base material layer 14 in the state of a collective substrate, and, by patterning the metal foil by photolithography, for example, external electrodes P1 and P2 are provided on the back surface of the insulating base material layer 14.

It is to be noted that the second coil conductor (the coil conductor CP2) includes a wide portion WP of which the line width is larger than the line width of the first coil conductor (the coil conductor CP1).

This step of forming the plurality of coil conductors CP1, CP2, and CP3 including the first coil conductor (the coil conductor CP1) and the second coil conductor (the coil conductor CP2) on the plurality of insulating base material layers 11, 12, and 13 that are made of a thermoplastic resin is an example of the "coil conductor forming step".

In addition, interlayer connection conductors (the interlayer connection conductors V1, V2, V3, V4, V5, V6, V7, and V8 shown in FIG. 1B) are formed on the plurality of insulating base material layers 11, 12, 13, and 14. The interlayer connection conductors are provided by forming a through hole with a laser or other suitable method, then applying a conductive paste including one or more of Cu, Ag, Sn, Ni, and Mo or an alloy, for example, and curing (solidifying) the conductive paste through the subsequent heating and pressing. Therefore, the interlayer connection conductors preferably made of, for example, a material having a melting point (a melting temperature) lower than the temperature at the time of the subsequent heating and pressing.

Subsequently, as shown in (2) in FIG. 4, the insulating base material layers 14, 13, 12, and 11 are stacked in this order on a seat 5 having a high rigidity. At this time, the plurality of insulating base material layers 11, 12, 13, and are stacked so that the first coil conductor among the plurality of coil conductors CP1, CP2, and CP3 is the closest to the first principal surface of the stacked body when the first coil conductor (the coil conductor CP1) forms a stacked body. In addition, the plurality of insulating base material layers 11, 12, 13, and 14 are stacked so that the second coil conductor (the coil conductor CP2) may be adjacent to or in a vicinity of the first coil conductor (the coil conductor CP1).

A step of stacking the plurality of insulating base material layers 11, 12, 13 and 14 after the "coil conductor forming step," such that the first coil conductor among the plurality of coil conductors CP1, CP2, and CP3 may be the closest to the first principal surface when the stacked body is formed and such that the second coil conductor may be adjacent to or in a vicinity of the first coil conductor, is an example of the "stacking step".

Subsequently, the plurality of insulating base material layers 11, 12, 13, and 14 that have been stacked are heated and pressed to form a stacked body 10. Specifically, the plurality of insulating base material layers 11, 12, 13, and 14 that have been stacked are heated and are subject to isotropic pressing (pressed) by hydrostatic pressure from a direction of the white arrow shown in (2) in FIG. 4.

In such a case, the non-overlapping portion NOP1 of the wide portion that does not overlap with the first coil conductor when viewed from the Z-axis direction includes a lower number of conductors that overlap in the stacking direction than the overlapping portion OP1 of the wide portion that overlaps the first coil conductor (the coil conductor CP1) when viewed from the Z-axis direction. Therefore, as compared with the vicinity of the overlapping portion OP1, the insulating base material layer at the vicinity of the non-overlapping portion NOP1 during heating and pressing is easy to deform, and the non-overlapping portion NOP1 is curved to be closer to the first principal surface VS1 than to the overlapping portion OP1.

A step of curving the overlapping portion OP1 to be closer to the first principal surface VS1 than to the overlapping portion OP1 by forming a stacked body 10 by heating and pressing the plurality of insulating base material layers 11, 12, 13, and 14 that have been stacked after the "stacking step" is an example of the "stacked body forming step".

Finally, the collective substrate is separated into individual pieces, so that a multilayer substrate 101 as shown in (3) in FIG. 4 is provided.

With this manufacturing method, a multilayer substrate is provided in which a positional shift of the coil conductors when a stacked body is formed is significantly reduced or prevented, and thus a change in characteristics of the coil is significantly reduced or prevented.

It is to be noted that, while the manufacturing method shows a method of forming a stacked body 10 by heating the plurality of insulating base material layers 11, 12, 13, and 14 that have been stacked and performing isotropic pressing (pressing) by hydrostatic pressure, the method of forming a stacked body is not limited to this example. For example, after a plurality of insulating base material layers are stacked on a seat having a high rigidity, by pressing (performing quasi-isostatic pressing to) the plurality of insulating base material layers that have been stacked by a member having a high rigidity through a cushion member having a low rigidity such as silicon, a stacked body may be formed.

Second Preferred Embodiment

In a second preferred embodiment of the present invention, a description is provided of an example that is different in the configuration of the coil from the first preferred embodiment.

Figure 5A:
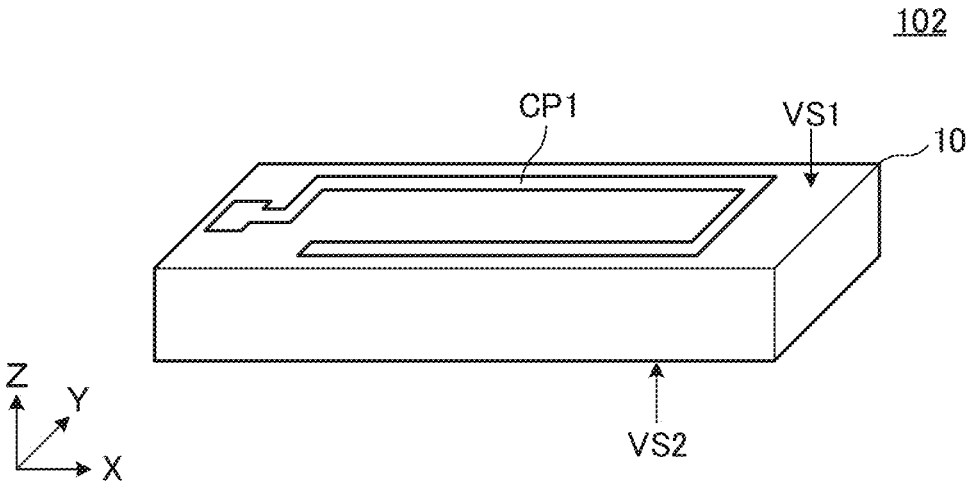
FIG. 5A is a perspective view of a multilayer substrate 102 according to a second preferred embodiment of the present invention.
Figure 5B:
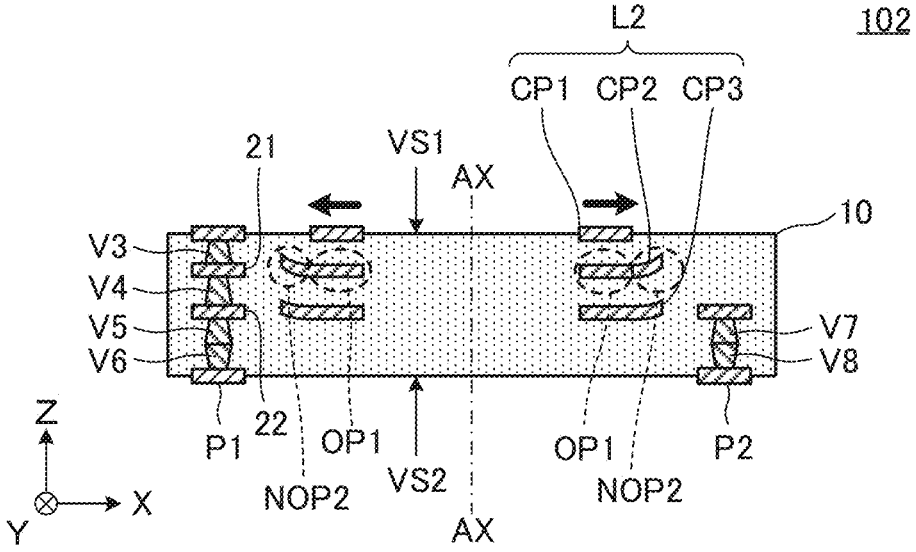
FIG. 5B is a cross-sectional view of the multilayer substrate 102.

FIG. 5A is a perspective view of a multilayer substrate 102 according to the second preferred embodiment of the present invention, and FIG. 5B is a cross-sectional view of the multilayer substrate 102.

The multilayer substrate 102 includes a stacked body 10, a coil L2 provided in contact with the stacked body 10, and external electrodes P1 and P2.

The multilayer substrate 102 is different in the configuration of the coil L2 from the multilayer substrate 101 according to the first preferred embodiment. Other configurations are the same or substantially the same as the configurations of the multilayer substrate 101.

Hereinafter, the differences from the multilayer substrate 101 according to the first preferred embodiment are described.

In the coil L2 according to the second preferred embodiment, as shown in FIG. 5B, the non-overlapping portion NOP2 that is curved to be closer to the first principal surface VS1 than to the overlapping portion OP1, is located on the outer peripheral side (a side of the coil conductor CP2 farther from the winding axis AX) in the radial direction (the Y-axis direction or the X-axis direction) of the second coil conductor (the coil conductor CP2). Other configurations are the same or substantially the same as the configurations of the coil L1 described in the first preferred embodiment.

According to the multilayer substrate 102 of the second preferred embodiment of the present invention, the following advantageous effects in addition to the advantageous effects described in the first preferred embodiment are provided.

In the second preferred embodiment, the non-overlapping portion NOP2 is located on the outer peripheral side in the radial direction (the Y-axis direction or the X-axis direction) of the second coil conductor (the coil conductor CP2). With this configuration, the non-overlapping portion NOP2 does not prevent magnetic field generation (e.g., magnetic flux that passes through a coil opening of the coil L2) of the coil L2. In addition, with this configuration, as compared with a case in which the non-overlapping portion is located on the inner peripheral side in the radial direction of the second coil conductor, the coil opening of the coil is able to be increased, so that electromagnetic force generated by interaction between the magnet and the coil is able to be increased.

Third Preferred Embodiment

In a third preferred embodiment of the present invention, a description is provided of an example that is different in the configuration of a coil from each of the above-described preferred embodiments.

Figure 6A:
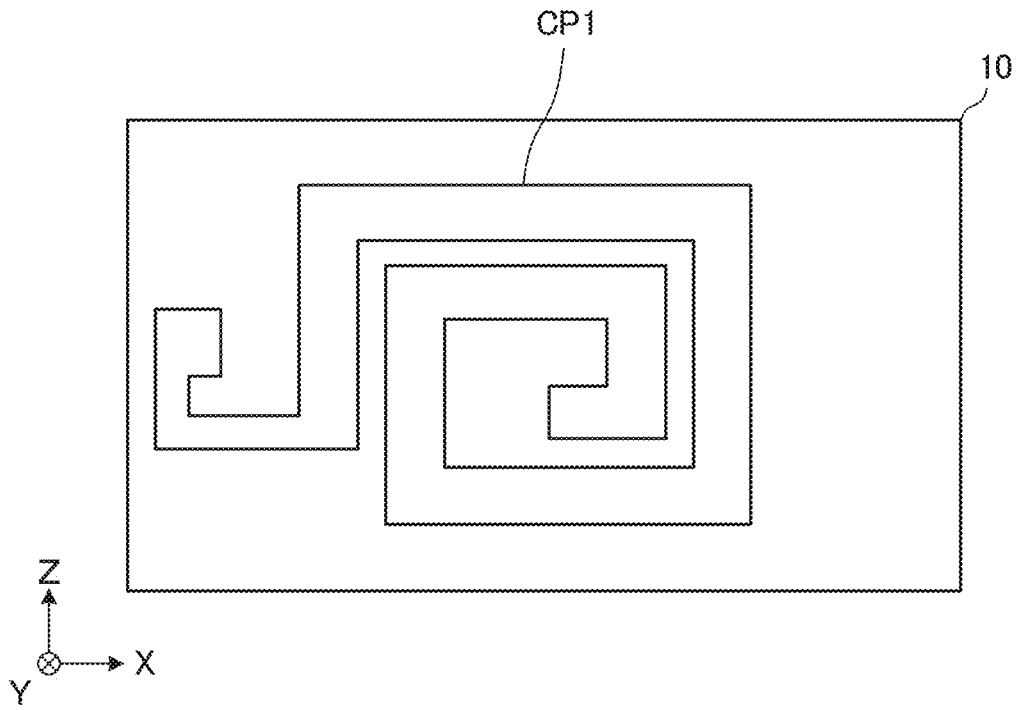
FIG. 6A is a plan view of a multilayer substrate 103 according to a third preferred embodiment of the present invention.
Figure 6B:
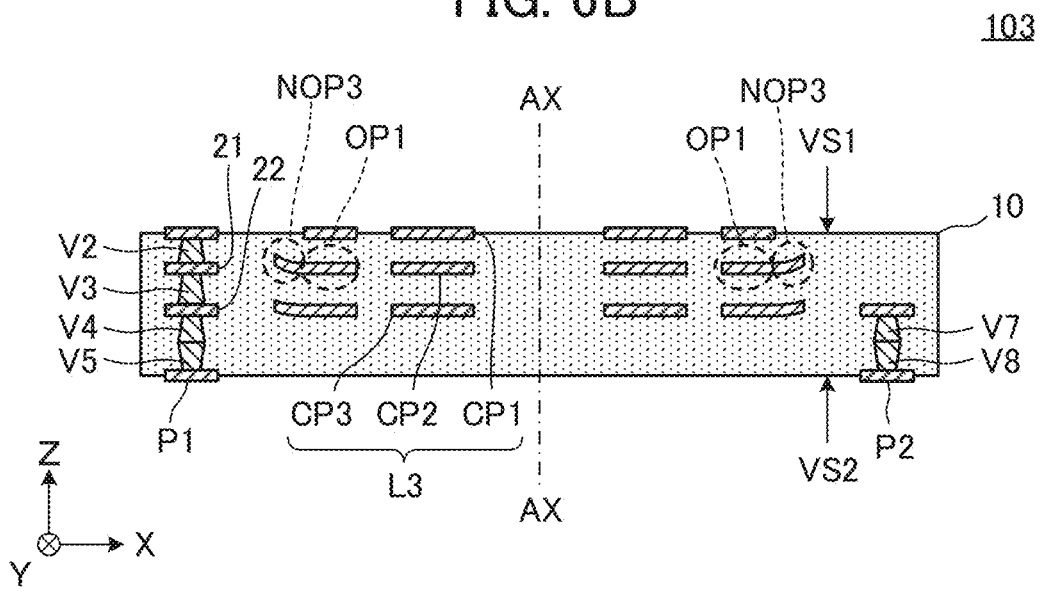
FIG. 6B is a cross-sectional view of the multilayer substrate 103.
Figure 7:
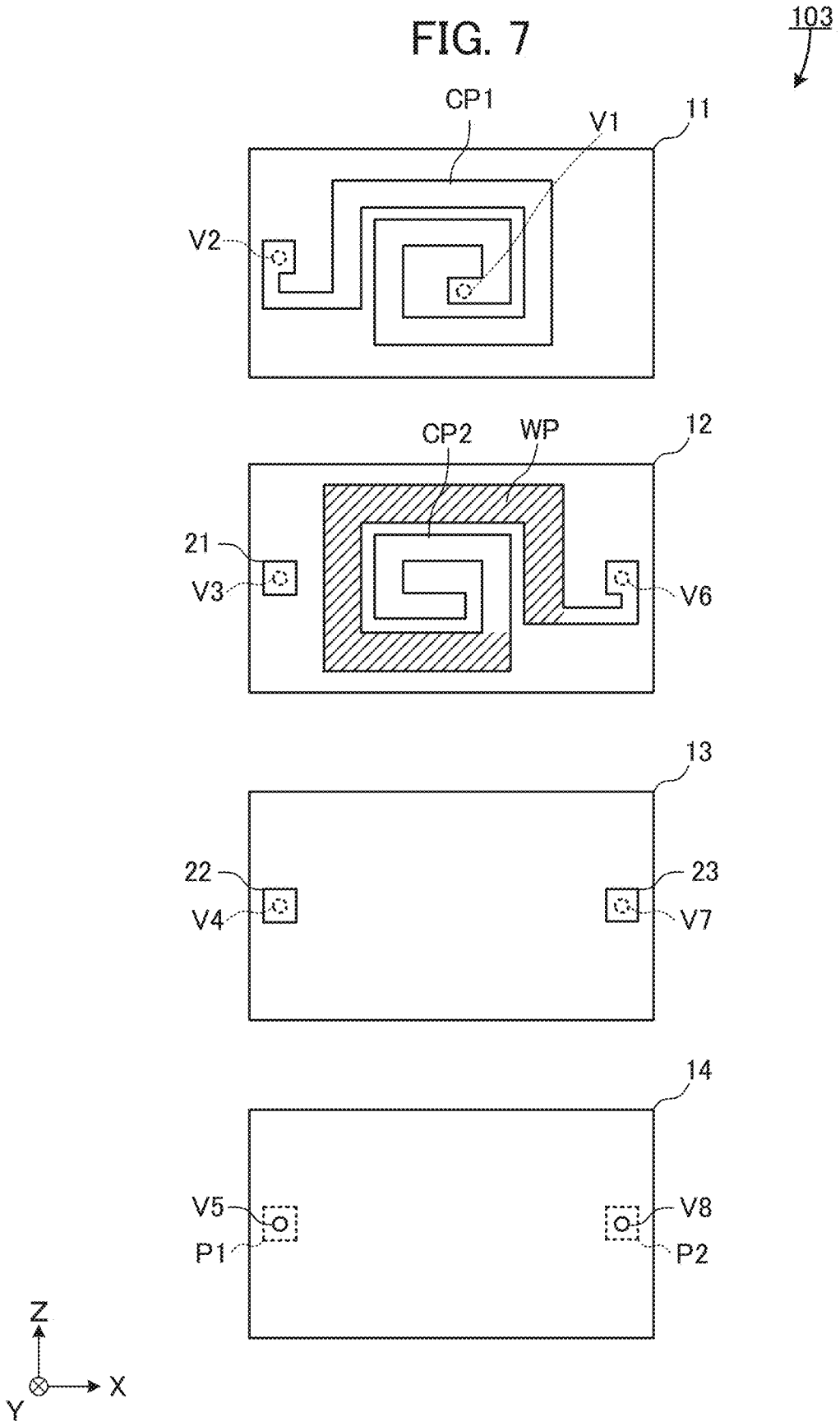
FIG. 7 is an exploded plan view of the multilayer substrate 103.

FIG. 6A is a plan view of a multilayer substrate 103 according to the third preferred embodiment of the present invention, and FIG. 6B is a cross-sectional view of the multilayer substrate 103. FIG. 7 is an exploded plan view of the multilayer substrate 103. It is to be noted that, in FIG. 7, in order to make the structure more understandable, a wide portion WP is indicated by hatching.

The multilayer substrate 103 includes a stacked body 10, a coil L3 (described below) provided in contact with the stacked body 10, and external electrodes P1 and P2.

The multilayer substrate 103 is different in the configuration of the coil L3 from the multilayer substrate 101 according to the first preferred embodiment. Other configurations are the same or substantially the same as the configurations of the multilayer substrate 101.

Hereinafter, the differences from the multilayer substrate 101 according to the first preferred embodiment are described.

The stacked body 10 is formed by stacking a plurality of insulating base material layers 11, 12, 13, and 14 that made of a thermoplastic resin.

A coil conductor CP1 is provided on a surface of the insulating base material layer 11. The coil conductor CP1 is a rectangular or substantially rectangular spiral-shaped conductor of about 1.5 turns wound along the outer periphery of the insulating base material layer 11. In addition, the insulating base material layer 11 includes interlayer connection conductors V1 and V2.

A coil conductor CP2 and a conductor 21 are provided on a surface of the insulating base material layer 12. The coil conductor CP2 is a rectangular or substantially rectangular spiral-shaped conductor of about 2 turns wound along the outer periphery of the insulating base material layer 12. The conductor 21 is a rectangular or substantially rectangular conductor disposed in a vicinity of the center of a first side (the left side of the insulating base material layer 12 in FIG. 7) of the insulating base material layer 12. In addition, the insulating base material layer 12 includes interlayer connection conductors V3 and V6.

Conductors 22 and 23 are provided on a surface of the insulating base material layer 13. The conductor 22 is a rectangular or substantially rectangular conductor disposed in a vicinity of the center of a first side (the left side of the insulating base material layer 13 in FIG. 7) of the insulating base material layer 13. The conductor 23 is a rectangular or substantially rectangular conductor disposed in the vicinity of the center of a second side (the right side of the insulating base material layer 13 in FIG. 7) of the insulating base material layer 13. In addition, the insulating base material layer 13 includes interlayer connection conductors V4 and V7.

External electrodes P1 and P2 are provided on a back surface of the insulating base material layer 14. The external electrode P1 is a rectangular or substantially rectangular conductor disposed in a vicinity of the center of a first side (the left side of the insulating base material layer 14 in FIG. 7) of the insulating base material layer 14. The external electrode P2 is a rectangular or substantially rectangular conductor disposed in the vicinity of the center of a second side (the right side of the insulating base material layer 14 in FIG. 7) of the insulating base material layer 14. In addition, the insulating base material layer 14 includes interlayer connection conductors V5 and V8.

As mainly shown in FIG. 7, a first end of the coil conductor CP1 is electrically connected to a first end of the coil conductor CP2 through the interlayer connection conductor V1. Accordingly, the coil conductors CP1 and CP2 respectively provided on the insulating base material layers 11 and 12 and the interlayer connection conductor V1 define a coil L3 including about 3.5 turns.

In addition, a first end (a second end of the coil conductor CP1) of the coil L3 is electrically connected to the external electrode P1, and a second end (a second end of the coil conductor CP2) of the coil L3 is electrically connected to the external electrode P2. Specifically, as mainly shown in FIG. 7, the first end (the second end of coil conductor CP1) of the coil L3 is electrically connected to the external electrode P1 through the conductors 21 and 22 and the interlayer connection conductors V2, V3, V4, and V5. In addition, the second end (the second end of the coil conductor CP2) of the coil L3 is electrically connected to the external electrode P2 through the interlayer connection conductors V6, V7 and V8.

In addition, as shown in FIG. 7, the second coil conductor (the coil conductor CP2) includes a wide portion WP of which the line width is larger than the line width of the first coil conductor (the coil conductor CP1). In the third preferred embodiment, only the outer peripheral portion of the coil conductor CP2 defines the wide portion WP. As shown in FIG. 6B, the wide portion WP of the second coil conductor includes an overlapping portion OP1 that overlaps with the first coil conductor when viewed from the Z-axis direction and a non-overlapping portion NOP3 that does not overlap with the first coil conductor when viewed from the Z-axis direction. As shown in FIG. 6B, the non-overlapping portion NOP3 is curved to be closer to the first principal surface VS1 than to the overlapping portion OP1.

Even with such a configuration, the multilayer substrate 103 according to the third preferred embodiment includes the same or substantially the same configuration as the multilayer substrate 101 described in the first preferred embodiment, and provides advantageous effects the same as or similar to the advantageous effects of the multilayer substrate 101.

It is to be noted that the "wide portion" according to the third preferred embodiment of the present invention does not need to be the entire or substantially the entire second coil conductor (the coil conductor CP2). As shown in the third preferred embodiment, the second coil conductor may include the wide portion WP in a portion of the second coil conductor.

In addition, as shown in the third preferred embodiment, a coil conductor (the coil conductor CP3 described in the first preferred embodiment, for example) other than the first coil conductor (the coil conductor CP1) and the second coil conductor (the coil conductor CP2) is dispensable.

It is to be noted that, even with a configuration in which the wide portion is not the outer peripheral portion of the second coil conductor (the coil conductor CP2) but only the inner peripheral portion of the second coil conductor (the coil conductor CP2), the wide portion includes an overlapping portion and a non-overlapping portion with the first coil conductor (the coil conductor CP1) from the Z-axis direction, and the non-overlapping portion is curved in a direction toward the first principal surface VS1, a similar effect is able to be provided.

Fourth Preferred Embodiment

In a fourth preferred embodiment of the present invention, a description is provided of an example that is different in the configuration of a coil from each of the above-described preferred embodiments.

Figure 8:
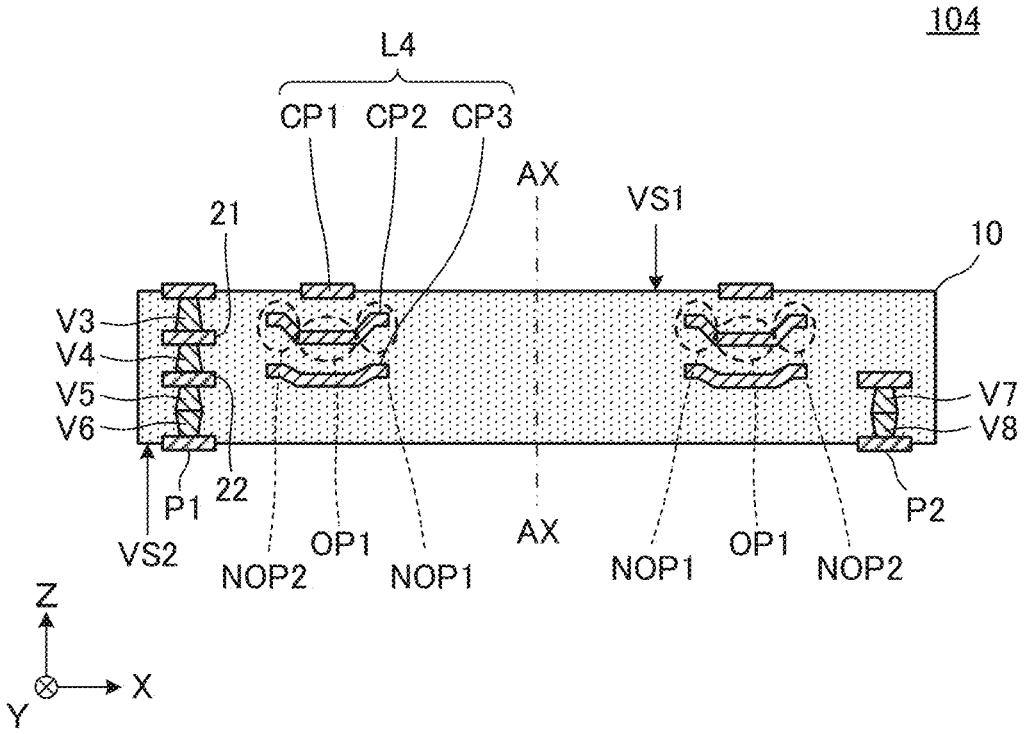
FIG. 8 is a cross-sectional view of a multilayer substrate 104 according to a fourth preferred embodiment of the present invention.

FIG. 8 is a cross-sectional view of a multilayer substrate 104 according to the fourth preferred embodiment of the present invention.

The multilayer substrate 104 includes a stacked body 10, a coil L4 provided in contact with the stacked body 10, and external electrodes P1 and P2.

The multilayer substrate 104 is different in the configuration of the coil L4 from the multilayer substrate 101 according to the first preferred embodiment. Other configurations are the same or substantially the same as the configurations of the multilayer substrate 101.

Hereinafter, the differences from the multilayer substrate 101 according to the first preferred embodiment are described.

In the coil L4 according to the fourth preferred embodiment, as shown in FIG. 8, the non-overlapping portions NOP1 and NOP2 that are curved to be closer to the first principal surface VS1 than to the overlapping portion OP1, are respectively provided on both of the inner peripheral side (a side of the coil conductor CP2 closer to the winding axis AX) and the outer peripheral side (a side of the coil conductor CP2 farther from the winding axis AX) in the radial direction (the X-axis direction or the Y-axis direction, for example) of the second coil conductor (the coil conductor CP2). Other configurations are the same or substantially the same as the configurations of the coil L1 described in the first preferred embodiment.

With this configuration, as compared with a case in which the non-overlapping portion is provided on one of the inner peripheral side or the outer peripheral side in the radial direction (the X-axis direction or the Y-axis direction, for example) of the second coil conductor, a positional shift of the first coil conductor during heating and pressing is able to be further significantly reduced or prevented.

Fifth Preferred Embodiment

In a fifth preferred embodiment of the present invention, a description is provided of an example of a multilayer substrate that is able to further significantly reduce or prevent a positional shift of the first coil conductor during heating and pressing.

Figure 9:
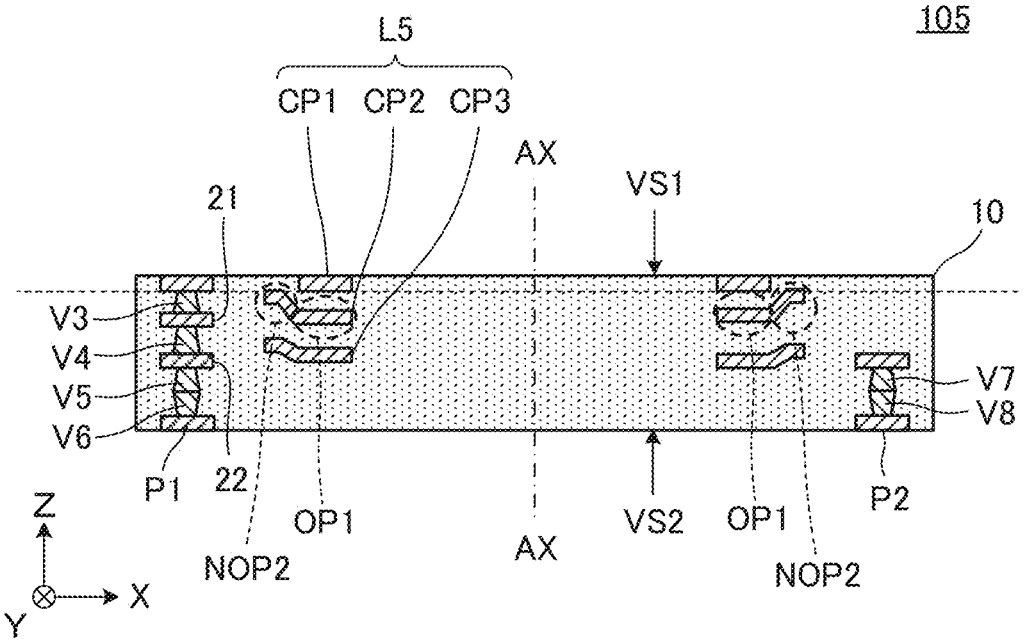
FIG. 9 is a cross-sectional view of a multilayer substrate 105 according to a fifth preferred embodiment of the present invention.

FIG. 9 is a cross-sectional view of a multilayer substrate 105 according to the fifth preferred embodiment of the present invention.

The multilayer substrate 105 includes a stacked body 10, a coil L5 provided in contact with the stacked body 10, and external electrodes P1 and P2.

The multilayer substrate 105 is different in the configuration of the coil L5 from the multilayer substrate 101 according to the first preferred embodiment. Other configurations are the same or substantially the same as the configurations of the multilayer substrate 101.

Hereinafter, the differences from the multilayer substrate 101 according to the first preferred embodiment are described.

In the coil L5 according to the fifth preferred embodiment, as shown in FIG. 9, a portion of the non-overlapping portion NOP2 that is curved to be adjacent to or in a vicinity of the first principal surface VS1 is curved to the same or substantially the same position as the position of the first coil conductor (the coil conductor CP1) in the Z-axis direction.

According to the multilayer substrate 105 of the fifth preferred embodiment of the present invention, the following advantageous effects in addition to the advantageous effects described in the first preferred embodiment are provided.

In the fifth preferred embodiment, a portion of the non-overlapping portion NOP2 of the second coil conductor (the coil conductor CP2) is curved to the same or substantially the same position as the position of the first coil conductor (the coil conductor CP1) in the Z-axis direction. With this configuration, a flow of an insulating base material layer in the vicinity of the first principal surface VS1 during heating and pressing is further significantly reduced or prevented, so that a positional shift of the first coil conductor during heating and pressing is further significantly reduced or prevented.

Such a multilayer substrate 105 (a stacked body) is provided by stacking a plurality of insulating base material layers (the insulating base material layers 11, 12, 13, and 14 shown in FIG. 4) on a seat having a high rigidity and then pressing (pressurizing) by a member having a high rigidity the plurality of insulating base material layers that have been stacked.

While each of the above-described preferred embodiments shows an example in which the stacked body is a rectangular or substantially rectangular flat plate, preferred embodiments of the present invention are not limited to such a configuration. The planar shape of the stacked body is able to be appropriately changed within the scope of operations and features of the preferred embodiments of the present invention, and may be a circle, an ellipse, or a polygon, for example. In addition, the first principal surface VS1 and the second principal surface VS2 of the stacked body may not be limited to a perfect plane and may be a partially curved surface or a similar surface, for example. It is to be noted that the second principal surface is dispensable in the stacked body of preferred embodiments of the present invention.

In addition, while each of the above-described preferred embodiments is an example of a multilayer substrate including a stacked body provided by stacking four insulating base material layers, preferred embodiments of the present invention are not limited to such a configuration. The number of layers of the insulating base material layers including a stacked body is able to be appropriately changed within the scope of operations and features of the preferred embodiments of the present invention.

It is to be noted that, while each of the above-described preferred embodiments shows an example in which a coil includes two or three coil conductors provided on a plurality of insulating base material layers, preferred embodiments of the present invention are not limited to such a configuration. The coil according to preferred embodiments of the present invention may include four or more coil conductors. Further, the shape and number of windings of a coil are able to be appropriately changed within the scope of operations and features of the preferred embodiments of the present invention. The coil according to preferred embodiments of the present invention is not limited to a helical shape, as with the coil L3 according to the third preferred embodiment.

While each of the above-described preferred embodiments shows an example in which a conductor (a coil conductor, an external electrode, and another conductor) is provided only on one principal surface of the insulating base material layer, preferred embodiments of the present invention are not limited to such a configuration. The conductor, such as a coil conductor or the like, may be provided on both principal surfaces of the insulating base material layer.

While each of the above-described preferred embodiments shows an example in which the external electrodes P1 and P2 are provided on the second principal surface VS2 of the stacked body, the multilayer substrate and the actuator according to preferred embodiments of the present invention are not limited to such a configuration. The number, shape, and arrangement of the external electrodes P1 and P2 are able to be appropriately changed within the scope of operations and features of the preferred embodiments of the present invention. The external electrodes may be provided on the first principal surface VS1 or may be provided on both of the first principal surface VS1 and the second principal surface VS2.

In addition, a protective layer, such as a cover lay film and a solder resist film, for example, may be provided on the first principal surface VS1 or the second principal surface VS2 of the stacked body.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A multilayer substrate comprising:

a stacked body including a principal surface and provided by stacking a plurality of insulating base material layers made of a thermoplastic resin; and a coil including:

a plurality of coil conductors provided on the plurality of insulating base material layers; and a winding axis extending in a stacking direction in which the plurality of insulating base material layers are stacked; wherein the plurality of coil conductors include:

a first coil conductor that is closest to the principal surface; and a second coil conductor adjacent to or in a vicinity of the first coil conductor and including a wide portion of which a line width is larger than a line width of the first coil conductor;

the wide portion includes:

an overlapping portion that overlaps with the first coil conductor when viewed from the stacking direction; and a non-overlapping portion that does not overlap with the first coil conductor when viewed from the stacking direction, and is adjacent to the overlapping portion in a width direction that is perpendicular or substantially perpendicular to an extension direction of the second coil conductor;

the non-overlapping portion is curved to be closer to the principal surface than to the overlapping portion; and when viewed from the stacking direction, the non-overlapping portion is located on at least one of an outer peripheral side and an inner peripheral side of the second coil conductor in the width direction, at the wide portion.

2. The multilayer substrate according to claim 1, wherein the non-overlapping portion includes a portion that is curved to a same or substantially a same position as a position of the first coil conductor in the stacking direction.

3. The multilayer substrate according to claim 1, wherein the non-overlapping portion, when viewed from the stacking direction, is located on the outer peripheral side in a radial direction of the second coil conductor, at the wide portion.

4. The multilayer substrate according to claim 1, wherein the non-overlapping portion, when viewed from the stacking direction, is located on the inner peripheral side in a radial direction of the second coil conductor, at the wide portion.

5. The multilayer substrate according to claim 1, wherein the first coil conductor, when viewed from the stacking direction, includes an area of which more than half overlaps with the wide portion.

6. The multilayer substrate according to claim 1, wherein each of the plurality of insulating base material layers is flexible and is a flat plate with a rectangular or substantially rectangular shape.

7. The multilayer substrate according to claim 1, wherein each of the plurality of coil conductors is a rectangular or substantially rectangular loop-shaped conductor.

8. The multilayer substrate according to claim 1, wherein a first end of the first coil conductor is electrically connected to a first end of the second coil conductor via a first interlayer connection conductor.

9. The multilayer substrate according to claim 1, wherein a second end of the second coil conductor is electrically connected to a first end of the third coil conductor via a second interlayer connection conductor.

10. The multilayer substrate according to claim 1, wherein the coil includes three turns that are defined by the plurality of coil conductors.

11. The multilayer substrate according to claim 1, wherein a first end of the coil is electrically connected to a first external electrode, and a second end of the coil is electrically connected to a second external electrode.

12. The multilayer substrate according to claim 1, wherein a second end of the second coil conductor is electrically connected to a first external electrode, and a second end of the third coil conductor is electrically connected to a second external electrode.

13. An actuator comprising:

the multilayer substrate according to claim 1; and a magnet; wherein the magnet is closest to the first coil conductor among the plurality of coil conductors.

14. The actuator according to claim 13, further comprising:

a movable object; wherein the magnet is attached to the movable object.

15. The actuator according to claim 14, wherein, in response to a predetermined current flowing in the coil, a magnetic field emitted from the coil displaces the magnet and the movable object in a direction perpendicular or substantially perpendicular to the stacking direction.

16. A method of manufacturing a multilayer substrate, comprising, in sequence:

a coil conductor forming step of forming a plurality of coil conductors on a plurality of insulating base material layers made of a thermoplastic resin, the plurality of coil conductors including a first coil conductor and a second coil conductor including a wide portion of which a line width is larger than a line width of the first coil conductor;

a stacking step of stacking the plurality of insulating base material layers and placing the second coil conductor adjacent to or in a vicinity of the first coil conductor; and a stacked body forming step of forming a stacked body including a principal surface by heating and pressing the plurality of insulating base material layers that have been stacked; wherein the first coil conductor among the plurality of coil conductors is closest to the principal surface and a non-overlapping portion of the wide portion is curved to be closer to the principal surface than to an overlapping portion of the wide portion;

the non-overlapping portion does not overlap with the first coil conductor when viewed from a stacking direction of the plurality of insulating base material layers; and the overlapping portion overlaps with the first coil conductor when viewed from the stacking direction.

17. The multilayer substrate according to claim 1, wherein the non-overlapping portion is included in a plurality of non-overlapping portions.

* * * * *